US008087954B2

(12) United States Patent
Fuchs

(10) Patent No.: US 8,087,954 B2
(45) Date of Patent: Jan. 3, 2012

(54) COAXIAL PLUG-TYPE CONNECTOR ARRANGEMENT

(75) Inventor: Josef Fuchs, Appenzell (CH)

(73) Assignee: Huber+Suhner AG (CH)

( * ) Notice: Subject to any disclaimer, the term of this patent is extended or adjusted under 35 U.S.C. 154(b) by 625 days.

(21) Appl. No.: 12/161,471

(22) PCT Filed: Dec. 20, 2006

(86) PCT No.: PCT/CH2006/000717
§ 371 (c)(1),
(2), (4) Date: Jul. 18, 2008

(87) PCT Pub. No.: WO2007/085099
PCT Pub. Date: Aug. 2, 2007

(65) Prior Publication Data

US 2011/0053397 A1 Mar. 3, 2011

(30) Foreign Application Priority Data

Jan. 26, 2006 (CH) ..... 0136/06

(51) Int. Cl.
*H01R 9/05* (2006.01)

(52) U.S. Cl. ..... 439/578; 439/352

(58) Field of Classification Search ..... 439/345, 439/350–354, 357, 358, 578, 675
See application file for complete search history.

(56) References Cited

U.S. PATENT DOCUMENTS

| | | | | |
|---|---|---|---|---|
| 6,709,289 | B2 * | 3/2004 | Huber et al. | 439/578 |
| 7,238,047 | B2 * | 7/2007 | Saettele et al. | 439/578 |
| 7,351,088 | B1 * | 4/2008 | Qu | 439/352 |
| 7,481,673 | B1 * | 1/2009 | Qu et al. | 439/578 |
| 7,553,185 | B1 * | 6/2009 | Qu et al. | 439/578 |
| 7,601,027 | B2 * | 10/2009 | Rosenberger | 439/578 |
| 2003/0153210 | A1 | 8/2003 | Huber et al. | |

FOREIGN PATENT DOCUMENTS

| | | |
|---|---|---|
| DE | 8714481 U1 | 12/1987 |
| EP | 1222717 B1 | 7/2002 |

* cited by examiner

*Primary Examiner* — Thanh Tam Le
(74) *Attorney, Agent, or Firm* — The Webb Law Firm

(57) ABSTRACT

A coaxial plug-type connector arrangement includes two plug-type connectors, which can be plugged one inside the other so as to latch in along a plug axis. Each plug-type connector includes a housing that extends in the direction of the plug axis and acts as an outer conductor. The housing has a drilled through-hole in which an inner conductor contact is held in insulated fashion with a coaxial arrangement. A coaxial contact sleeve is formed on the housing of the first plug-type connector, with which contact sleeve the plug-type connector enters the second plug-type connector so as to make contact when the two plug-type connectors are plugged one inside the other. A detachable tensioning sleeve for pre-stressing the two plug-type connectors with respect to one another in the plugged-in state is provided on the second plug-type connector.

8 Claims, 4 Drawing Sheets

COAXIAL PLUG-TYPE CONNECTOR ARRANGEMENT

BACKGROUND OF THE INVENTION

1. Field of the Invention

The present invention relates, in general, to the field of detachable connection techniques for coaxial cables and, more particularly, to a coaxial plug-in connector arrangement.

2. Description of Related Art

In the past, specific plug-in connector systems have been developed for detachably connecting coaxial cables which make it possible to plug together and detach the plug-in connection rapidly without any screwing operation and at the same time ensure safe and permanent contacts is provided. Such plug-in connector systems, which are based on the principles explained in the document mentioned at the outset, are known on the market under the type designation QMA (Quick Lock SMA).

A known embodiment of such a QMA plug-in connector system, as is produced and offered for sale by the Applicant, is reproduced in FIGS. 1-4. The system comprises two mutually fitting plug-in connectors 10 (male; FIGS. 1, 2) and 20 (female; FIGS. 3, 4), which can be plugged one inside the other so as to automatically latch with one another and so as to produce and maintain sufficient axial contact pressure and can be detached again later by actuating an axially displaceable actuating sleeve (15 in FIGS. 1, 2).

The male plug-in connector 10, which is illustrated in longitudinal section in FIG. 1 and in the perspective side view in FIG. 2, comprises a cylindrical housing 11, which is coaxial with respect to a plug axis 17 and acts as an outer conductor, having a coaxial through-hole 11' having a stepped diameter, in which an inner conductor contact 12 is arranged concentrically such that it is insulated by means of an insulating piece 13. In the front part of the plug-in connector 10, a tensioning sleeve 14, which is in contact with the housing 11, is inserted fixedly into the through-hole 11', in which tensioning sleeve a collar of hook-shaped latching fingers 19, which spring out radially, are formed by a large number of axial slots 18. In the region of the tensioning sleeve 14, an axially displaceable actuating sleeve 15 surrounds the housing 11 on the outside. At the front end of the actuating sleeve 15, a conically tapering unlatching ring 29 is integrally formed on the inner edge, and this unlatching ring engages in the collar of the latching fingers 19 and bends it radially outwards if the actuating sleeve 15 is displaced towards the rear in the axial direction. A clamping sleeve 16 is provided at the rear end of the plug-in connector 10, and this clamping sleeve can be used to fix the coaxial cable to the plug-in connector 10.

The associated female plug-in connector 20, which is likewise shown in section and in a perspective side view in FIGS. 3 and 4, comprises a cylindrical housing 21, which is coaxial with respect to the plug axis 28 and acts as an outer conductor, having a concentric through-hole 21' and an inner conductor contact 22, which is held concentrically in the through-hole 21' by means of an insulating piece 24. The inner conductor contact 22 has, at the front end, a contact tube 23 with slots, and the inner conductor contact 12 of the male plug-in connector 10 enters this contact tube 23 when the plug-in connectors 10, 20 are plugged together. The outer conductor contact is produced by a contact sleeve 25, which surrounds the insulating piece 24 and with which the plug-in connector 20 enters the tensioning sleeve 14 of the plug-in connector 10 during the plugging-in operation and rests on the base of the tensioning sleeve 14. A clamping sleeve 26 for fixing the coaxial cable is likewise provided at the rear end of the plug-in connector 20.

The resilient latching fingers 19 of the tensioning sleeve 14 in the process slide with their front, hook-shaped ends over a circumferential bead 27, which is formed on the outside of the contact sleeve 25 and increases slowly and then falls away comparatively steeply in terms of diameter. In this way, the latching fingers 19 latch in behind the bead 27 and exert a force acting in the plug-in direction on the contact sleeve 25, as is described in EP-B1-1 222 717. The latching of the tensioning sleeve 14 and the contact sleeve 25 can be cancelled again by means of the actuating sleeve 15.

The described plug system has proven to be successful in practice, but is not suitable for all application cases since the connection of the inner conductor contacts 12, 22 and housing parts imparting the outer conductor contact is not completely protected from undesirable influences from the outside, in particular water or moisture. Such suitable sealing appears to be problematic since restrictive conditions are provided in the contact region of the system by the tensioning sleeve 14, which springs out radially, and the axially displaceable actuating sleeve 15.

SUMMARY OF THE INVENTION

The object of the invention is to provide a coaxial plug-in connector arrangement of the described type which avoids the disadvantages of the known embodiments and is sealed off reliably from the outside in the contact region without any substantial changes to the contact geometry.

The solution according to the invention is characterized by the fact that one or more seals are arranged within the tensioning means, which seals seal off the intermediate space between the contact sleeve and the through-hole of the second plug-in connector in the plugged-together state.

One configuration of the invention is characterized by the fact that the tensioning sleeve engages behind a circumferential bead formed on the contact sleeve during the plugging-in operation with hook-shaped latching fingers, which extend counter to the plug-in direction and spring out radially, that the contact sleeve enters the through-hole of the second plug-in connector so as to provide contact during the plugging-in operation, that the tensioning sleeve is pushed on the outside fixedly onto the housing of the second plug-in connector, and that the at least one seal is annular and is arranged directly between the contact sleeve and the inner wall surrounding it of the through-hole of the second plug-in connector.

In particular, it is advantageous owing to the simplicity of the design if the at least one seal is accommodated in the housing of the second plug-in connector, if a circumferential annular groove is provided in the inner wall of the through-hole of the second plug-in connector, and if the at least one seal is in the form of an O ring and is arranged in the annular groove.

However, it is also conceivable within the context of the invention for the tensioning sleeve to be inserted fixedly into the through-hole of the second plug-in connector, and for the at least one seal to be arranged on the tensioning sleeve.

It is also conceivable that, within the tensioning means, in order to detach the tensioning sleeve, an actuating sleeve, which can be displaced in the axial direction and surrounds the two plug-in connectors on the outside in the plugged-in state, is provided, and that the actuating sleeve is sealed off with respect to the two plug-in connectors.

BRIEF DESCRIPTION OF THE DRAWINGS

The invention will be explained in more detail below with reference to exemplary embodiments in connection with the drawing, in which.

DETAILED DESCRIPTION OF THE PRESENT INVENTION

Figure 6:
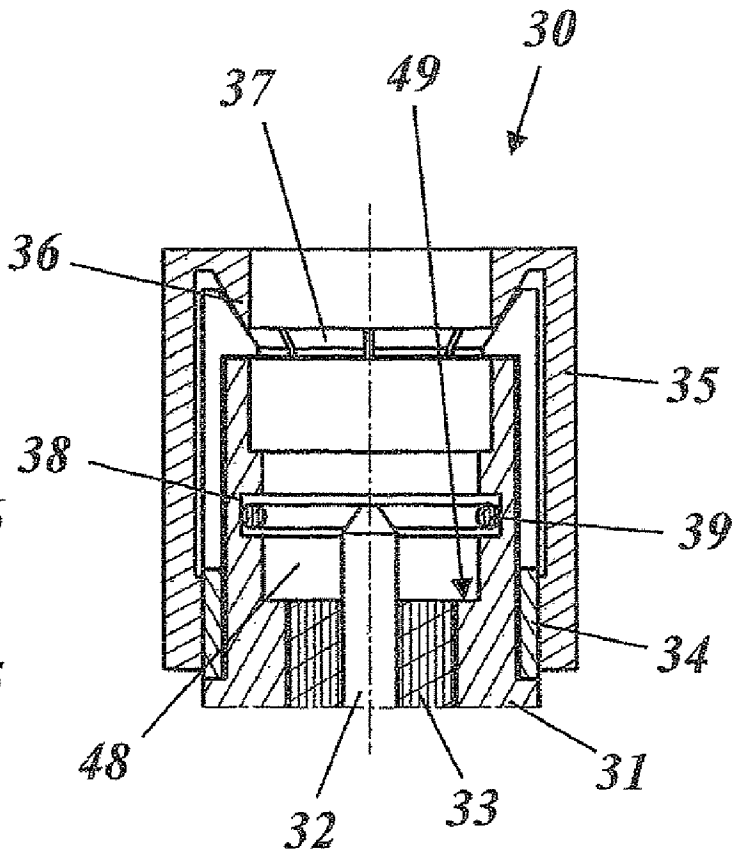
FIG. 6 shows, in longitudinal section, the male plug-in connector of the plug-in connector arrangement from FIG. 5.
Figure 5:
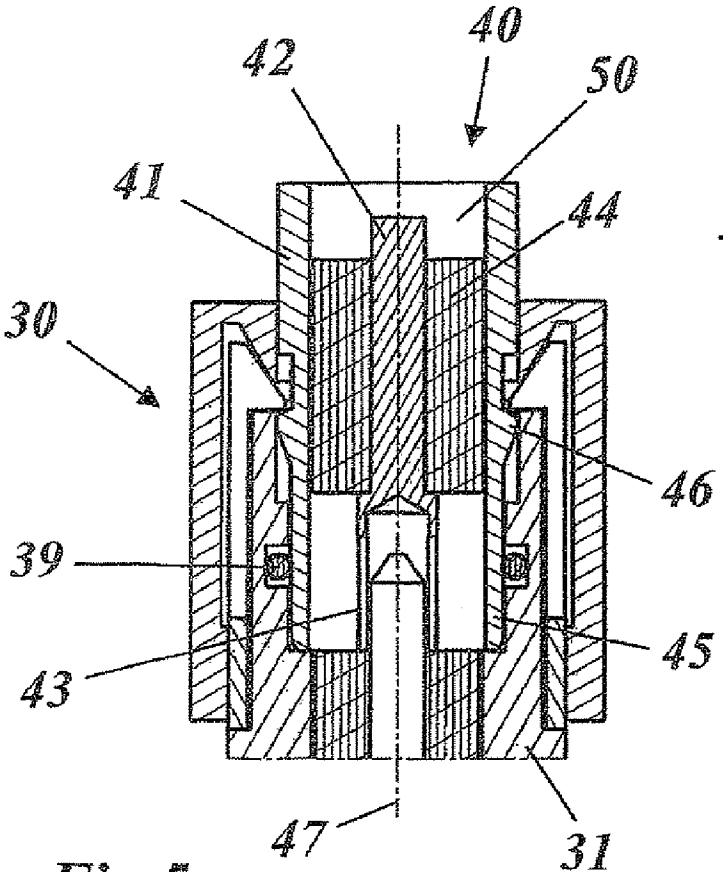
FIG. 5 shows, in longitudinal section, a detail of a plugged-together plug-in connector arrangement in accordance with one preferred exemplary embodiment of the invention.

A plugged-together plug-in connector arrangement in accordance with one preferred exemplary embodiment of the invention is reproduced in detail in FIG. 5 in longitudinal section, and in FIG. 6, the associated male plug-in connector, in which the sealing of the arrangement takes place, is reproduced on its own. The plug-in connector arrangement 30, 40 of the exemplary embodiment comprises a male plug-in connector 30 and a female plug-in connector 40.

Figure 4:
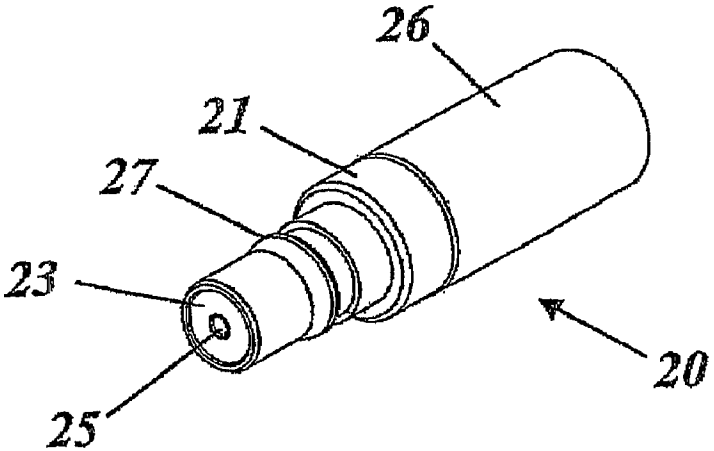
Fig.4 Prior art
FIG. 4 shows a perspective side view of the plug-in connector from FIG. 3.
Figure 3:
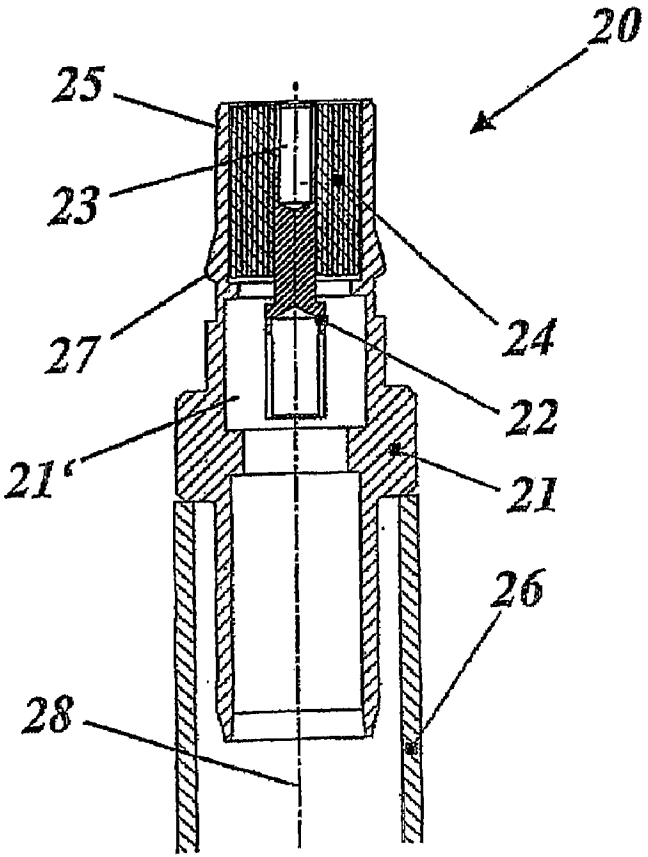
Fig.3 Prior art
FIG. 3 shows, in longitudinal section, the female plug-in connector, which fits the male plug-in connector from FIG. 1, from the prior art.

In principle, the female plug-in connector 40 may have the same design as in the prior art (FIGS. 3, 4). It has a cylindrical housing 41 acting as an outer conductor and having a through-hole 50, which is coaxial with respect to the plug axis 47 and in which an inner conductor contact 42 is arranged coaxially by means of an insulating piece 44, which inner conductor contact becomes a contact tube 43 with slots at the front end of the plug-in connector 40. In the plugged-in state, the contact tube 43 accommodates the inner conductor contact 32 (FIG. 6) of the male plug-in connector 30. The housing 41 of the plug-in connector 40 becomes a contact sleeve 45 at the front end, which contact sleeve is inserted into the other plug-in connector 30 and produces the outer conductor contact there. At the rear end of the contact sleeve 45, a circumferential bead 46 is formed in a manner known per se, which bead has a slowly increasing diameter enlargement on the front side and, on the other hand, a comparatively severely falling diameter reduction in size on the rear side. The bead 46, in connection with a tensioning sleeve 34 on the male plug-in connector 30, is used for latching the two plug-in connectors 30, and for producing an axial contact force, which presses the contact sleeve 45 against a diameter step 49 in the plug-in connector 30 so as to provide contact with the end side.

The male plug-in connector 30 (FIG. 6) likewise has a cylindrical housing 31 (not completely illustrated in FIGS. 5, 6) having a through-hole 48, which is coaxial with respect to the plug axis 47. An inner conductor contact 32 is mounted coaxially in the through-hole 48 by means of an insulating piece 33. The through-hole 48 has a diameter step 49, on which the contact sleeve 45 of the other plug-in connector 40 rests in the plugged-in state. The inner conductor contact 32 protrudes with its front end beyond the diameter step 49 and thus forms a contact plug which fits the contact tube 43.

On the outside, a coaxial tensioning sleeve 34 is pushed onto the front end of the housing 31 so as to have a fixed fit, and spring-elastic latching fingers 37 are formed on said tensioning sleeve by means of a plurality of axial slots, which latching fingers engage with their front, hook-shaped ends around the front end of the housing 31 and protrude radially into the through-hole 48. An actuating sleeve 35 is arranged so as to be axially displaceable coaxially over the tensioning sleeve 34 and can bend the latching arms 37 for unlatching purposes radially outwards and forwards behind the bead 46 by means of a conical unlatching ring 36 if the actuating sleeve 35 is pushed towards the rear (downwards in FIG. 6).

Owing to the tensioning sleeve 34 which is fitted on the outside on the housing 31, the plug-in connector 40, in the plugged-together state of the plug-in connector arrangement, bears with the contact sleeve 45 directly against the inner wall of the through-hole 48 and against the diameter step 49. This configuration provides the possibility of sealing off the contact region from the outside in a particularly simple manner by means of a seal arranged between the contact sleeve 45 and the inner wall of the through-hole 48. In the exemplary embodiment in FIGS. 5, 6, such a seal 39 is accommodated, for reasons of space, in an annular groove 38 in the inner wall of the through-hole 48 and is preferably in the form of an O ring. It is also possible for a plurality of seals to be arranged axially one behind the other, as a result of which, however, the plug-in forces are increased. Owing to the seal 39, the contact region of the outer conductors on the diameter step 49 and the inner conductor contacts in the contact tube 43 are sealed off from the outside.

Figure 2:
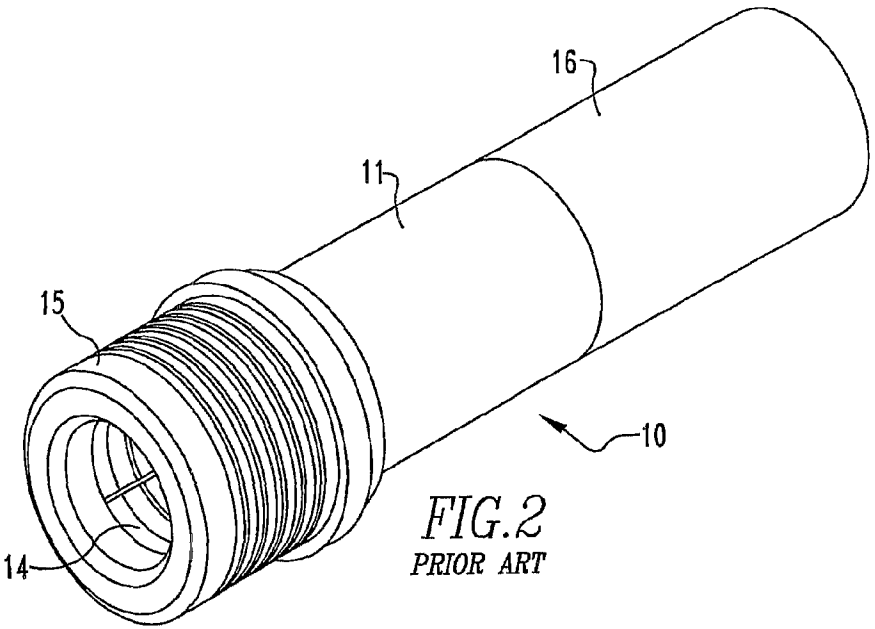
FIG. 2 PRIOR ART
FIG. 2 shows a perspective side view of the plug-in connector from FIG. 1.
Figure 1:
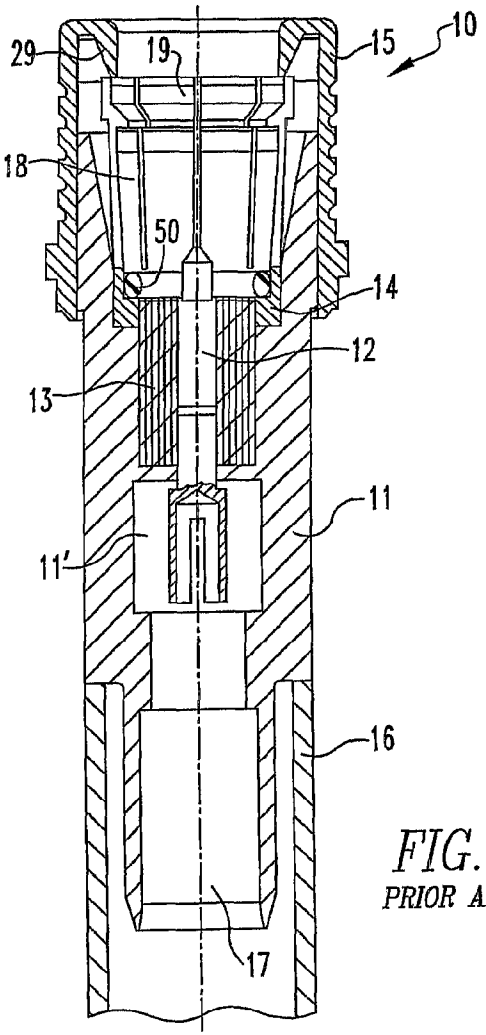
FIG. 1 PRIOR ART
FIG. 1 shows, in longitudinal section, the male plug-in connector of a coaxial plug-in connector arrangement from the prior art.
Figure 7:
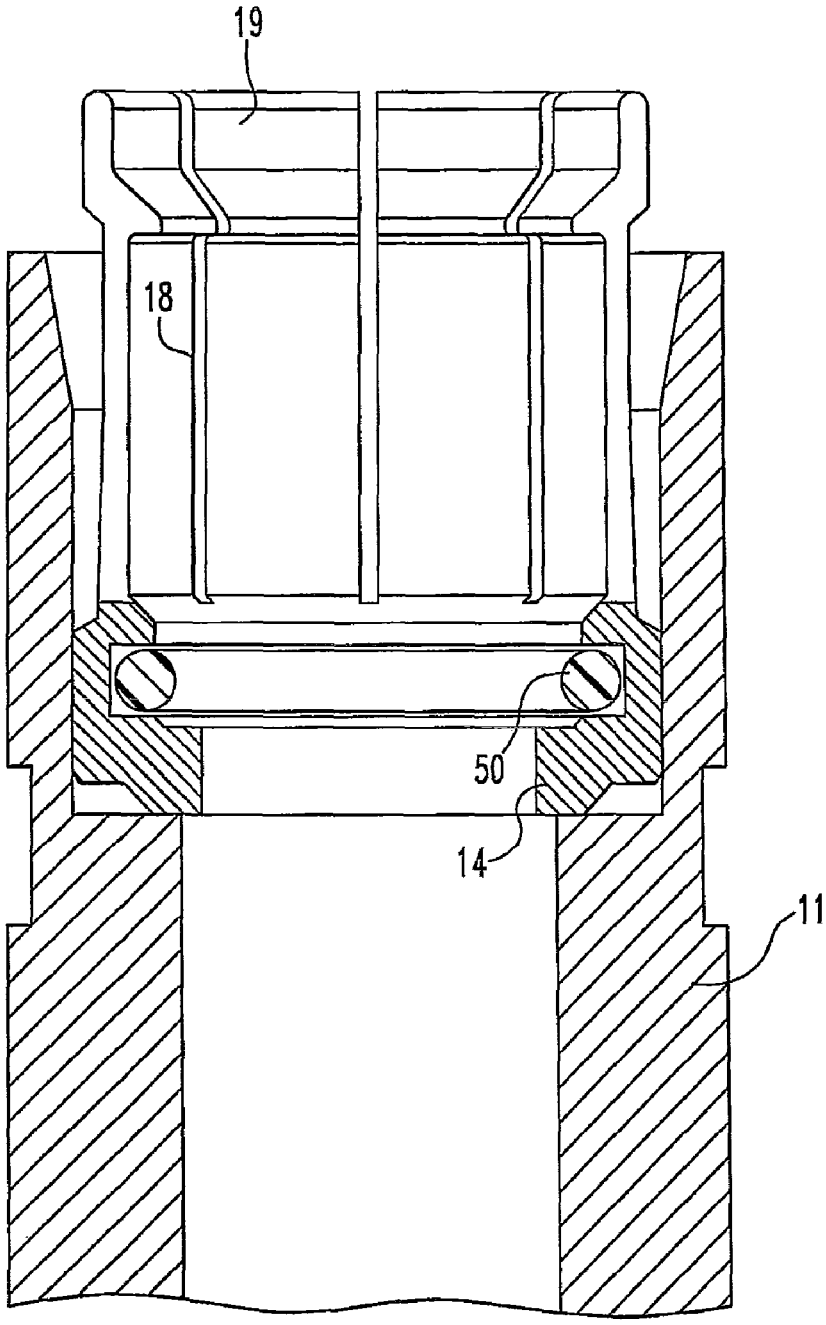
FIG. 7 shows, in longitudinal section, an enlarged portion of the male plug-in connector of the coaxial plug-in connector arrangement shown in FIG. 1.

However, other sealing configurations are also conceivable: if the tensioning sleeve—as is the case in the previously known plug arrangements shown in FIG. 1 and FIG. 7—is inserted fixedly into the through-hole of the second plug-in connector and the outer conductor contact is produced via the tensioning sleeve 14, it is expedient to arrange the seal or seals 50 on the tensioning sleeve 14 itself.

However, it is also possible (with increased complexity), in a configuration shown in FIG. 5, to seal off the actuating sleeve 35 from the housings 31 and 41 of the two plug-in connectors 30, 40 using corresponding seals at the two ends of the actuating sleeve 35.

The invention claimed is:

1. A coaxial plug-in connector arrangement comprising:

a first plug-in connector and a second plug-in connector, which can be inserted so as to latch one inside the other along a plug axis, each plug-in connector comprising a housing, which extends in the direction of the plug axis and acts as an outer conductor, having a through-hole, in which through-hole an inner conductor contact is held in insulated fashion in a coaxial arrangement;

a coaxial contact sleeve formed on the housing of the first plug-in connector, with which sleeve the first plug-in connector enters the second plug-in connector so as to provide contact when the two plug-in connectors are plugged one inside the other; and detachable tensioning means for prestressing the two plug-in connectors with respect to one another in a plugged-in state provided on the second plug-in connector, the tensioning means comprising a coaxial tensioning sleeve that coaxially surrounds the contact sleeve in the plugged-in state and applies a force acting in a plug-in direction thereto, wherein one or more seals are arranged within the tensioning sleeve that seal off the intermediate space between the contact sleeve and the through-hole of the second plug-in connector in the plugged-in state; and wherein the coaxial tensioning sleeve engages a circumferential bead formed on the contact sleeve during a plugging-in operation with latching fingers, which extend counter to the plug-in direction and spring out radially.

2. The coaxial plug-in connector arrangement according to claim 1, wherein the contact sleeve enters the through-hole of the second plug-in connector so as to provide contact during a plugging-in operation.

3. The coaxial plug-in connector arrangement according to claim 2, wherein the tensioning sleeve is pushed on an outside thereof fixedly onto the housing of the second plug-in connector, and the one seal is annular and is arranged directly between the contact sleeve and an inner wall of the through-hole of the second plug-in connector.

4. The coaxial plug-in connector arrangement according to claim 3, wherein the one seal is accommodated in the housing of the second plug-in connector.

5. The coaxial plug-in connector arrangement according to claim 4, wherein a circumferential annular groove is provided in the inner wall of the through-hole of the second plug-in connector, and the one seal is in the form of an O-ring and is arranged in the annular groove.

6. The coaxial plug-in connector arrangement according to claim 2, wherein the tensioning sleeve is inserted fixedly into the through-hole of the second plug-in connector, and the one seal is arranged on the tensioning sleeve.

7. The coaxial plug-in connector arrangement according to claim 1, wherein, in order to detach the tensioning means, an actuating sleeve, which is configured to be displaced in an axial direction and surrounds the first plug-in connector and the second plug-in connector on an outside in the plugged-in state, is provided, and the actuating sleeve is sealed off with respect to the first plug-in connector and the second plug-in connector.

8. The coaxial plug-in connector arrangement according to claim 1, wherein said latching fingers are hook-shaped latching fingers.

* * * * *